US006970149B2

(12) United States Patent
Chung et al.

(10) Patent No.: US 6,970,149 B2
(45) Date of Patent: Nov. 29, 2005

(54) ACTIVE MATRIX ORGANIC LIGHT EMITTING DIODE DISPLAY PANEL CIRCUIT

(75) Inventors: Choong-heui Chung, Daejeon (KR); Chi-sun Hwang, Daejeon (KR); Yoon-ho Song, Daejeon (KR); Jin-ho Lee, Daejeon (KR)

(73) Assignee: Electronics and Telecommunications Research Institute, (KR)

( * ) Notice: Subject to any disclaimer, the term of this patent is extended or adjusted under 35 U.S.C. 154(b) by 277 days.

(21) Appl. No.: 10/334,837

(22) Filed: Dec. 31, 2002

(65) Prior Publication Data

US 2004/0051685 A1 Mar. 18, 2004

(30) Foreign Application Priority Data

Sep. 14, 2002 (KR) ..... 10-2002-0055995

(51) Int. Cl.[7] ..... G09G 3/32
(52) U.S. Cl. ..... 345/82; 345/78; 345/204; 315/169.3
(58) Field of Search ..... 345/76–83, 204; 315/169.1, 169.2, 169.3

(56) References Cited

U.S. PATENT DOCUMENTS 5,973,456 A * 10/1999 Osada et al. ..... 315/169.1
6,091,392 A * 7/2000 Imamura ..... 345/100
6,229,506 B1 5/2001 Dawson et al.
6,307,322 B1 10/2001 Dawson et al.
6,501,466 B1 * 12/2002 Yamagishi et al. ..... 345/204
6,697,057 B2 * 2/2004 Koyama et al. ..... 345/204
6,713,324 B2 * 3/2004 Shiba et al. ..... 438/149

OTHER PUBLICATIONS

R.M.A. Dawson, et al., "A Poly-Si Active-Matrix OLED Display with Integrated Drivers," SID 1999 Digest, pp. 438-441, Princeton, NJ.

Akira Yumoto, Mitsuru Asano, Hiroshi Hasegawa and Mitsunobu Sekiya, "Pixel-Driving Methods for Large-Sized Poly-Si AM-OLED Displays," Asia Display/IDW '01, p. 1395-1398, Sony Corporation Core Technology & Network Company Japan.

* cited by examiner

*Primary Examiner*—Lun-yi Lao
(74) *Attorney, Agent, or Firm*—Blakely, Sokoloff, Taylor & Zafman

(57) ABSTRACT

An active matrix organic light emitting diode display panel circuit capable of reducing current and brightness nonuniformities between pixels by including a threshold voltage compensation circuit block between a data line and the pixels is provided. The threshold voltage of a video signal loaded in a data line is compensated for while the video signal passes through the threshold voltage compensation circuit block and then provided to a driving transistor of the pixels. One threshold voltage compensation circuit block is connected commonly to a plurality of pixels, rather than be connected to every pixel, so that threshold voltage compensation can be achieved for high-quality, large-sized displays, without increasing the number of transistors for the pixels.

9 Claims, 5 Drawing Sheets

ACTIVE MATRIX ORGANIC LIGHT EMITTING DIODE DISPLAY PANEL CIRCUIT

BACKGROUND OF THE INVENTION

This application claims the priority of Korean Patent Application No. 2002-55995, filed Sep. 14, 2002, in the Korean Intellectual Property Office, the disclosure of which is incorporated herein in its entirety by reference.

1. Field of the Invention

The present invention relates to a panel circuit structure for an active matrix organic light emitting diode display, capable of reducing current nonuniformities between pixels and nonuniformity in the brightness of the display.

2. Description of the Related Art

Conventionally, an active matrix organic light emitting diode panel circuit structure, as shown in FIG. 1, is widely known, where a plurality of pixels, each of which includes two thin film transistors, a capacitor, and an organic light emitting diode (OLED), are arranged in rows and columns.

As is well known, in the conventional active matrix OLED panel circuit, upon selection of a scan line 100 a video signal loaded in a data line 101 is input to a driving transistor 112 via an addressing transistor 111 to control the current through an OLED 130. The video signal is stored in a storage capacitor 120 for one frame time duration.

Most thin film transistors (TFTs), such as the addressing transistor 111 and the driving transistor 112 of FIG. 1, used in active matrix OLED display panels are formed using polysilicon. Threshold voltage variation in such a TFT leads to current nonuniformities between pixels and nonuniform brightness. These problems are not significant in gray-scale displays smaller than 2 inches. A larger display undergoes more serious threshold nonuniformities, and the quality of the display greatly degrades.

FIG. 2 shows an example of a pixel structure suggested for threshold voltage nonuniformity compensation in a polysilicon TFT, in which a plurality of pixels each including four TFTs, two capacitors, and an OLED are arranged in rows and columns. Referring to FIG. 2, upon selection of a scan line 200, a video signal loaded in a data line 203 is input to a driving transistor 212 via an addressing transistor 211 to control the current through an OLED 230. The video signal is stored in a storage capacitor 222 for one frame time duration. In FIG. 2, reference numerals 201 and 202 denote an auto zero line and an illuminate line, respectively. Reference numerals 213 and 214 denote a transistor whose gate is connected to the auto zero line 201 and a transistor whose gate is connected to the illuminate line 202, respectively. A capacitor 221 is located between the drain of the addressing transistor 211 and the gate of the driving transistor 212. The application of this pixel structure eliminates the threshold voltage nonuniformity in the driving transistor 212, and thus gray-scale display can be implemented. However, the increase in the number of TFTs constituting one pixel to four reduces panel yield and the illumination area of each pixel. As a result, the brightness of the display decreases. Moreover, the current density in the OLED increases, thereby shortening the lifetime of the display.

SUMMARY OF THE INVENTION

Accordingly, the invention provides an active matrix organic light emitting diode (OLED) display panel circuit capable of reducing threshold voltage nonuniformities between pixels without increasing pixel size.

In an aspect, the invention provides an active drive OLED display panel circuit having a plurality of pixels, each of which includes an addressing transistor, a storage capacitor, an OLED, and a driving transistor connected in series to the OLED, wherein a threshold voltage compensation circuit block is disposed outside the pixels so that a video signal loaded in a data line is transmitted via the threshold voltage compensation circuit block to the pixels, i.e., the gate of the driving transistor.

According to the present invention, the threshold voltage compensation circuit block is connected commonly to at least two pixels, rather than be connected to every pixel, so that integration efficiency is ensured for the display. In this case, the threshold voltage compensation circuit block is connected in parallel to the at least two pixels. At least two threshold voltage compensation circuit blocks can be connected in parallel to the data line.

According to the present invention, the threshold voltage compensation circuit block comprises at least two thin film transistors, which are connected in parallel with each other. At least one of the thin film transistors has the same conductivity type as the driving transistor. It is preferable that when the at least two thin film transistors have different conductivity types, the at least two thin film transistors be connected in parallel with a common gate.

According to the present invention, the threshold voltage of a video signal loaded in a data line is compensated for while the video signal passes through the threshold voltage compensation circuit block, and then the video signal is input to the gate of the driving transistor of pixels. As a result, the threshold voltage nonuniformity between pixels can be reduced. Also, high-quality, large-sized displays can be implemented without increasing the area occupied by transistors in the pixels.

BRIEF DESCRIPTION OF THE DRAWINGS

The above features and advantages of the present invention will become more apparent by describing in detail exemplary embodiments thereof with reference to the attached drawings in which.

DETAILED DESCRIPTION OF THE INVENTION

Embodiments of the present invention will be described more fully with reference to the accompanying drawings. This invention may, however, be embodied in many different forms and should not be construed as being limited to the embodiments set fourth herein; rather, these embodiments are provided so that this disclosure will be thorough and complete to those skilled in the art.

Figure 3:
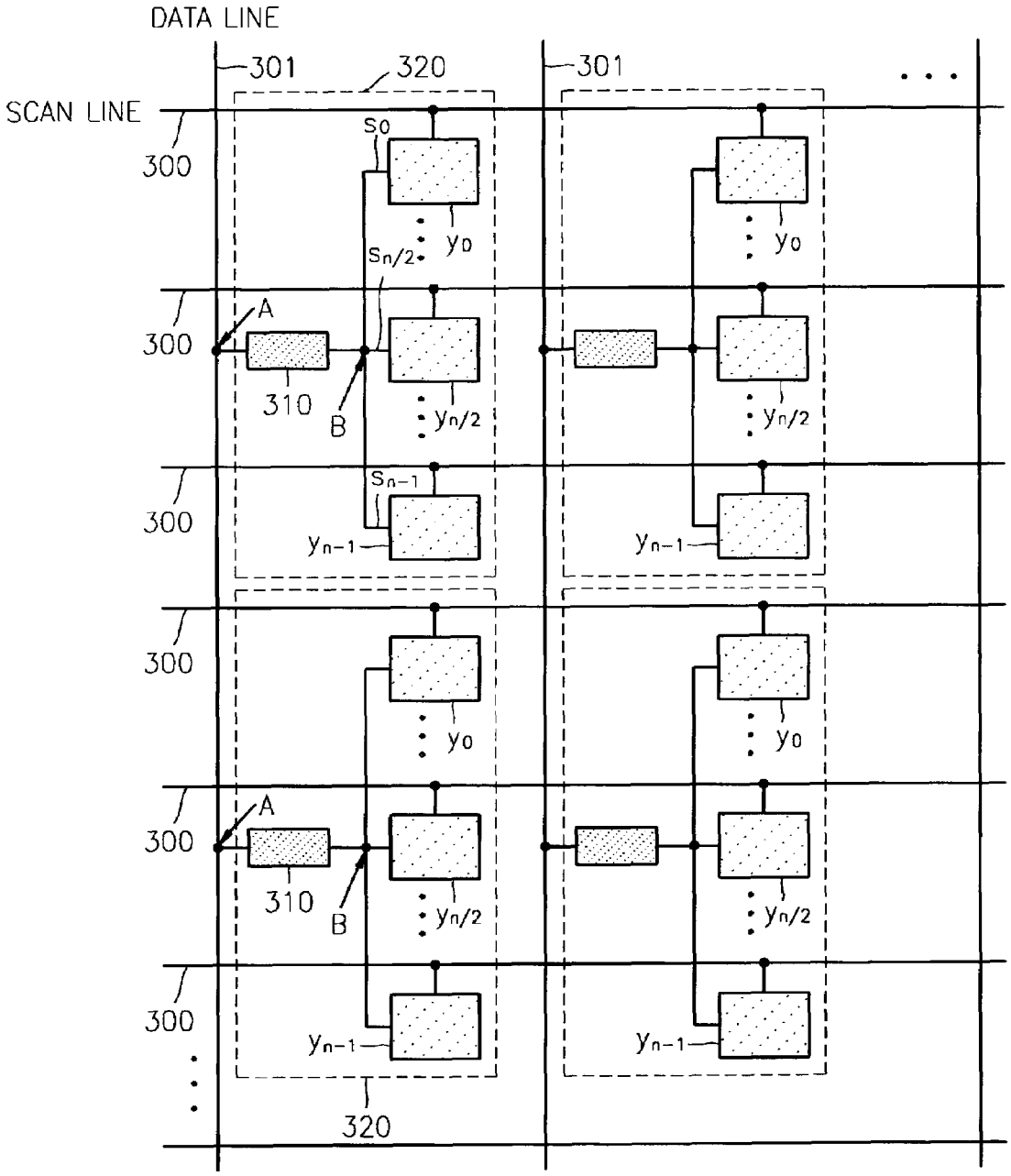
FIG. 3 depicts a schematic diagram of an active matrix OLED display panel circuit having a threshold voltage compensation circuit block according to the present invention.

An active matrix organic light emitting diode (OLED) display panel circuit having a threshold voltage compensation block according to the present invention is shown in FIG. 3, and structural examples of the threshold voltage compensation circuit block of FIG. 3 are shown in FIGS. 4 through 7.

Figure 1:
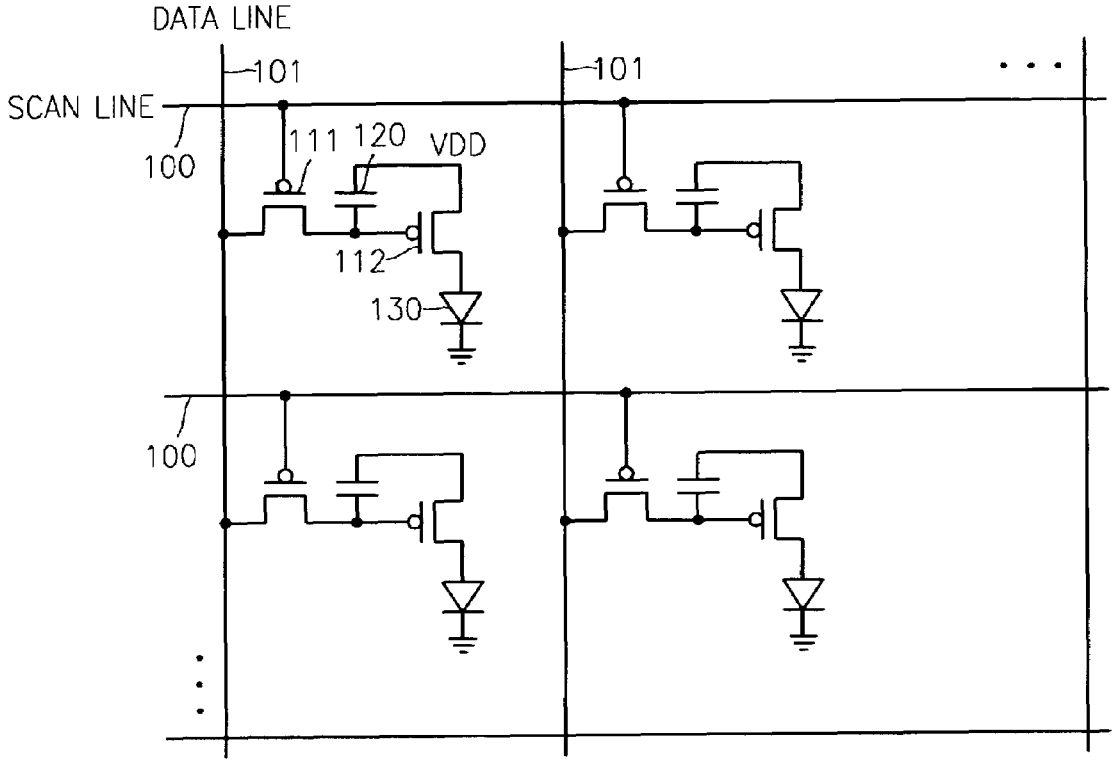
FIG. 1 (PRIOR ART)
FIG. 1 depicts a schematic diagram of a conventional active matrix organic light emitting diode (OLED) display panel structure.
Figure 2:
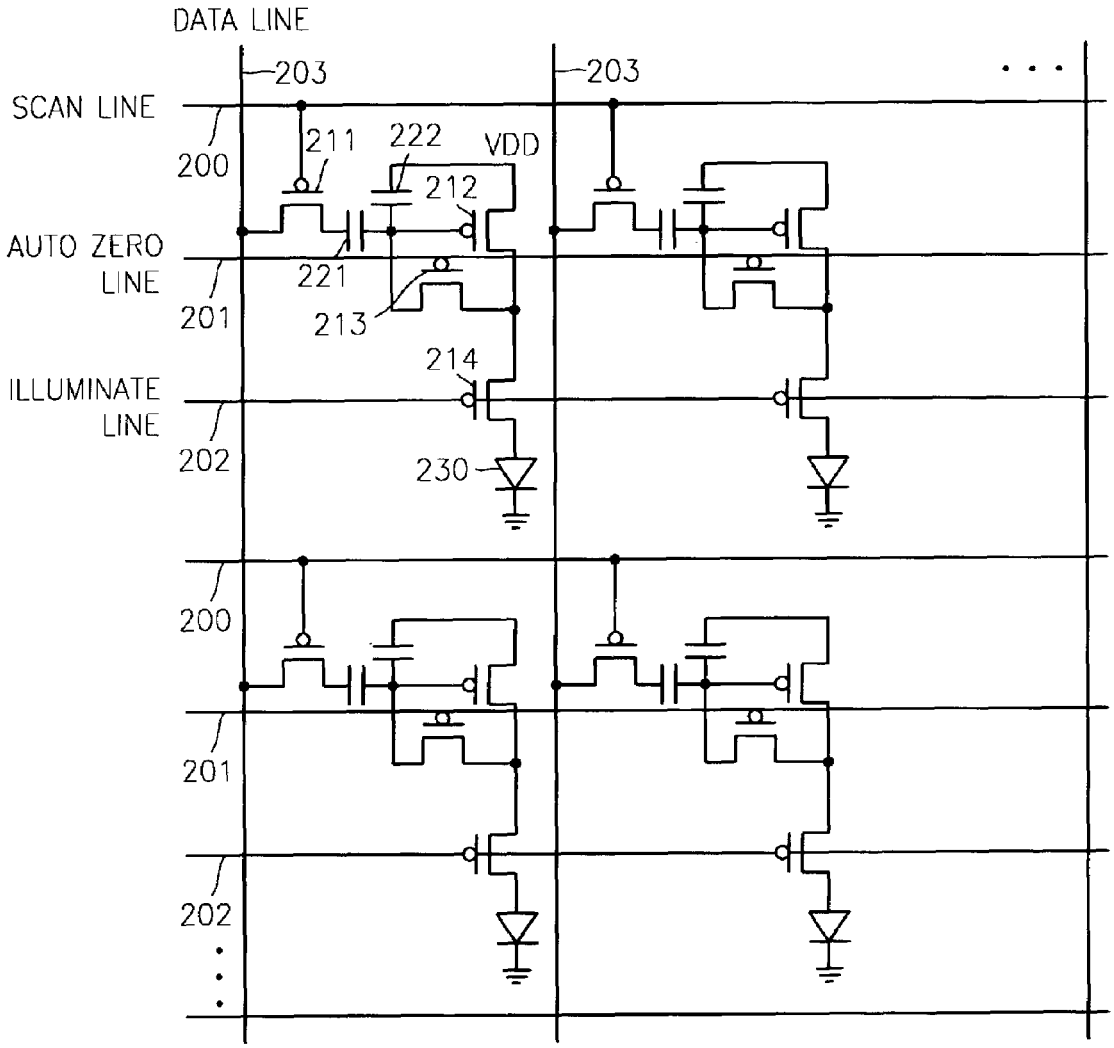
FIG. 2 (PRIOR ART)
FIG. 2 depicts a schematic diagram of a conventional pixel structure suggested in order to compensate for threshold voltage nonuniformities in thin film transistors of the structure shown in FIG. 1.

Referring to FIG. 3, in the active drive OLED display panel circuit structure according to the present invention scan lines 300 and data lines 301 are arranged in rows and columns, respectively. An input terminal A of a threshold voltage compensation circuit block 310 is connected to a data line 301, and an output terminal B of the threshold voltage compensation circuit block 310 is connected in parallel to n pixels $y_0$–$y_{n-1}$, where n is greater than or equal to 1. Each of the pixels $y_0$–$y_{n-1}$ includes an addressing transistor, a storage capacitor, an OLED, and a driving transistor connected in series to the OLED. For the connection of the addressing transistor, the driving transistor, the storage capacitor, and the OLED, FIG. 1 can be referred to.

As shown in FIG. 3, in the active drive OLED display panel circuit, a plurality of units 320, each of which is constituted by the threshold voltage compensation circuit block 310 and n pixels $y_0$–$y_{n-1}$ connected to the output terminal B by sub data lines $s_0$–$s_{n-1}$, as indicated by dashed lines, are arranged in a matrix. The plurality of units 320 is connected in parallel to one data line 301.

The threshold voltage compensation circuit block 310 can be constituted of two or more thin film transistors (TFTs). In this case, the TFTs are connected in parallel. At least one of the TFTs has the same conductivity type as the driving transistor. When the two or more TFTs have different conductivity types, the TFTs are connected in parallel with a common gate. A detailed structure of the threshold voltage compensation circuit block 310 will be described later.

The active matrix OLED display panel circuit according to the present invention operates as follows. When one scan line 300 is selected, the corresponding pixel $y_0$ is activated to receive the video signal loaded in the data line 301. A voltage level of the video signal loaded in the data line 301 is changed (increased or decreased) by the threshold voltage of the TFTs in the threshold voltage compensation circuit block 310 while the video signal passes the threshold voltage compensation circuit block 310 and is input to the pixel $y_0$. Next, the video signal is stored in the storage capacitor for one frame time duration. Once the above series of operations is completed, the next scan line 300 is selected, and a pixel whose gate is connected to the selected scan line 300 receives the video signal whose voltage level has been changed by the threshold voltage of the TFTs in the threshold voltage compensation circuit block 310. The input of the video signal up to the pixel $y_{n-1}$ completes the video signal input operation in one unit 320 indicated by dashed lines. These operations are continued while the plurality of scan lines are selected one by one and are repeated in each frame.

In the active drive OLED display panel having the above configuration according to the present invention, the threshold voltage compensation circuit block 310 is disposed between the data line 301 and the addressing transistor. The video signal whose voltage level has been changed by the threshold voltage of the TFTs in the threshold voltage compensation circuit block 310 is transmitted to the pixels $y_0$–$y_{n-1}$, so that the threshold voltage nonuniformity between the pixels $y_0$–$y_{n-1}$ is reduced. Since one threshold voltage compensation circuit block 310 is commonly connected to a plurality of addressing TFTs, instead of increasing the number of TFTs in each pixel as in the prior art, integration efficiency is ensured for displays. Therefore, the threshold voltage variation between pixels can be compensated for without any reduction in the light emitting region of the pixels, so that high-quality, large-size displays can be implemented without yield and lifetime reductions.

Threshold voltage variation in driving transistors for OLEDs in a display panel becomes greater with increasing panel size. However, when the threshold voltage compensation circuit block 310 is used as in the present invention, high-definition, large-size displays can be implemented with the conventional simple pixel structure of FIG. 1 including two TFTs and a capacitor.

The number of pixels connected to the output terminal B of the threshold voltage compensation circuit block 310 can be varied according to the quality requirement of displays. For example, the number of pixels connected to the output terminal 310 of the threshold voltage compensation circuit block 310 can be reduced for a higher definition display.

The threshold voltage compensation circuit block 310 will be described in detail with reference to FIGS. 4 through 7.

Figure 4:
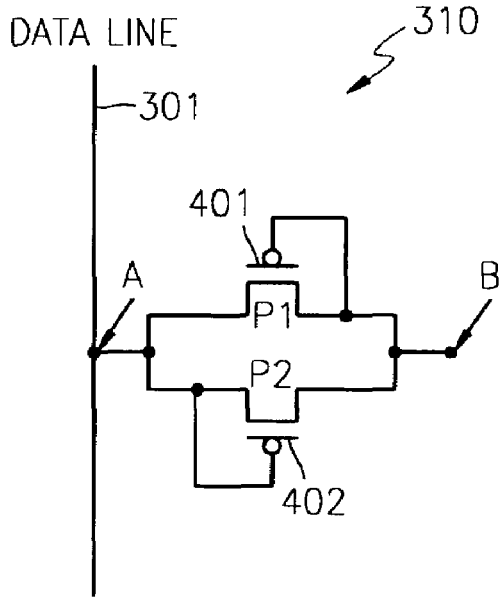
FIGS. 4 through 7 are exemplary circuit diagrams of the threshold voltage compensation circuit block shown in FIG. 3.

FIG. 4 shows an example of the threshold voltage compensation circuit block 310 implemented by connecting two p-type TFTs P1 (401) and P2 (402) in parallel. The gate of a first TFT 401 is disconnected from the output terminal B of the threshold voltage compensation circuit block 310, and the gate of a second TFT 402 is disconnected from the input terminal A of the threshold voltage compensation circuit block 310. This configuration is applied when the driving transistor is a p-type.

In the operation principles of the threshold voltage compensation circuit block 310 of FIG. 4, when a voltage level of the video signal transmitted to the input terminal A of the threshold voltage compensation circuit block 310 is greater than that at the output terminal B of the threshold voltage compensation circuit block 310, the second TFT 402 is turned off, and the first TFT 401 is turned on. As a result, the voltage level of the video signal is reduced by the threshold voltage of the first TFT 401, and the video signal is transmitted to the output terminal B of the threshold voltage compensation circuit block 310. In contrast, when a voltage level of the video signal transmitted to the input terminal A of the threshold voltage compensation circuit block 310 is smaller than that at the output terminal B of the threshold voltage compensation circuit block 310, the first TFT 401 is turned off, and the second TFT 402 is turned on. As a result, the voltage level of the video signal is increased by the threshold voltage of the second TFT 402, and the video signal is transmitted to the output terminal B of the threshold voltage compensation circuit block 310.

Figure 5:
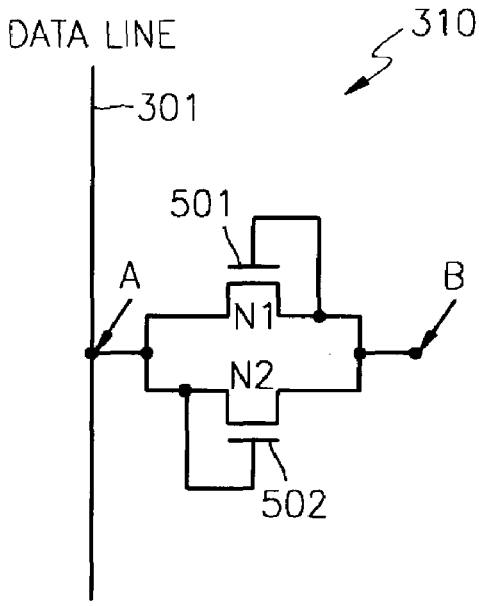

FIG. 5 shows another example of the threshold voltage compensation circuit block 310 implemented by connecting two n-type TFTs N1 (501) and N2 (502) in parallel. Referring to FIG. 5, the gate of a first TFT 501 is disconnected from the output terminal B of the threshold voltage compensation circuit block 310, and the gate of a second TFT 502 is disconnected from the input terminal A of the threshold voltage compensation circuit block 310. This configuration is applied when the driving transistor is an n-type.

The operation principles of the threshold voltage compensation circuit block 310 of FIG. 5 can be understood from those of the previous example described with reference to FIG. 4. In particular, when a voltage level of the video signal transmitted to the input terminal A of the threshold voltage compensation circuit block 310 is greater than that at the output terminal B of the threshold voltage compensation circuit block 310, the first TFT 501 is turned off, and the second TFT 502 is turned on. As a result, the voltage level of the video signal is reduced by the threshold voltage of the second TFT 502, and the video signal is transmitted to the output terminal B of the threshold voltage compensation circuit block 310. In contrast, when a voltage level of the video signal transmitted to the input terminal A of the threshold voltage compensation circuit block 310 is smaller than that at the output terminal B of the threshold voltage compensation circuit block 310, the second TFT 502 is turned off, and the first TFT 501 is turned on. As a result, the voltage level of the video signal is increased by the threshold voltage of the first TFT 501, and the video signal is transmitted to the output terminal B of the threshold voltage compensation circuit block 310.

Figure 6:
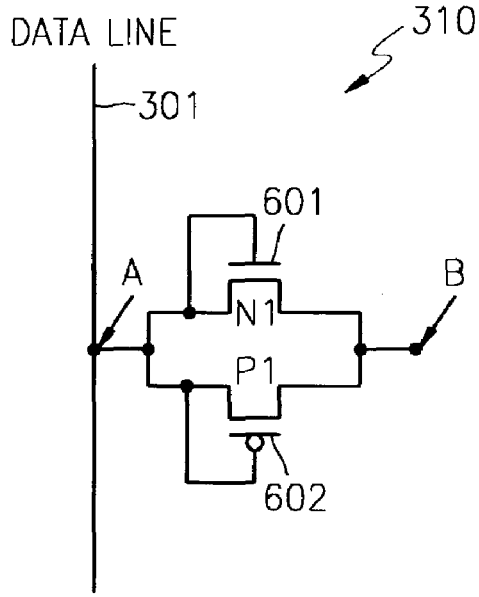

FIG. 6 shows another example of the threshold voltage compensation circuit block 310 implemented by connecting an n-type TFT N1 (601) and a p-type TFT P1 (602). As shown in FIG. 6, an n-type TFT 601 and a p-type TFT 602 are connected in parallel wit a common gate, and the common gate is disconnected from the input terminal A of the threshold voltage compensation circuit block 310. In order to vary the voltage level of the video signal by the threshold voltage of the n-type TFT 601, an n-type driving transistor is connected in series to the OLED. Likewise, in order to vary the voltage level of the video signal by the threshold voltage of the p-type TFT 602, a p-type driving transistor is connected in series to the OLED.

In the operation principles of the threshold voltage compensation circuit block 310 of FIG. 6, when a voltage level of the video signal transmitted to the input terminal A of the threshold voltage compensation circuit block 310 is greater than that at the output terminal B of the threshold voltage compensation circuit block 310, the p-type TFT 602 is turned off, and the n-type TFT 601 is turned on. As a result, the voltage level of the video signal is reduced by the threshold voltage of the n-type TFT 601, and the video signal is transmitted to the output terminal B of the threshold voltage compensation circuit block 310. In contrast, when a voltage level of the video signal transmitted to the input terminal A of the threshold voltage compensation circuit block 310 is smaller than that at the output terminal B of the threshold voltage compensation circuit block 310, the n-type TFT 601 is turned off, and the p-type TFT 602 is turned on. As a result, the voltage level of the video signal is increased by the threshold voltage of the p-type TFT 602, and the video signal is transmitted to the output terminal B of the threshold voltage compensation circuit block 310.

Figure 7:
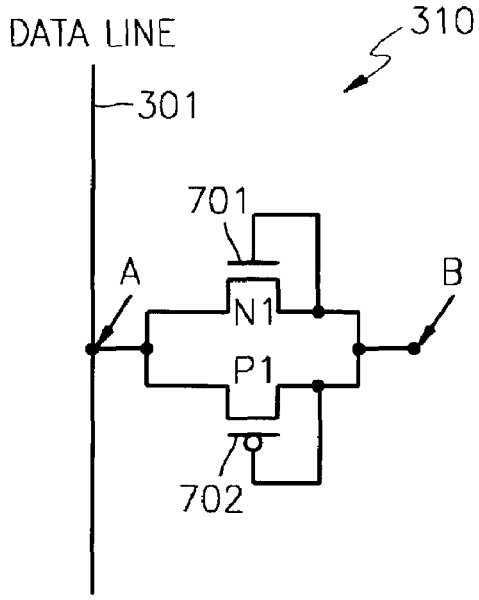

FIG. 7 shows another example of the threshold voltage compensation circuit block 310. The threshold voltage compensation circuit block 310 of FIG. 7 is implemented by connecting an n-type TFT N1 (701) and a p-type TFT P1 (702) with a common gate, as in the example of FIG. 6, but the common gate of an n-type TFT 701 and a p-type TFT 702 is disconnected from the output terminal B of the threshold voltage compensation circuit block 310. In order to vary the voltage level of the video signal by the threshold voltage of the n-type TFT 701, an n-type driving transistor is connected in series to the OLED. Likewise, in order to vary the voltage level of the video signal by the threshold voltage of the p-type TFT 702, a p-type driving transistor is connected in series to the OLED.

In the operation principles of the threshold voltage compensation circuit block 310 of FIG. 7, when a voltage level of the video signal transmitted to the input terminal A of the threshold voltage compensation circuit block 310 is greater than that at the output terminal B of the threshold voltage compensation circuit block 310, the n-type TFT 701 is turned off, and the p-type TFT 702 is turned on. As a result, the voltage level of the video signal is reduced by the threshold voltage of the p-type TFT 702, and the video signal is transmitted to the output terminal B of the threshold voltage compensation circuit block 310. In contrast, when a voltage level of the video signal transmitted to the input terminal A of the threshold voltage compensation circuit block 310 is smaller than that at the output terminal B of the threshold voltage compensation circuit block 310, the p-type TFT 702 is turned off, and the n-type TFT 701 is turned on. As a result, the voltage level of the video signal is increased by the threshold voltage of the n-type TFT 701, and the video signal is transmitted to the output terminal B of the threshold voltage compensation circuit block 310.

As described above, an active drive OLED display panel according to the present invention includes the threshold voltage compensation circuit block outside the pixels, i.e., between the data line and the addressing transistor of the pixels. As a result, the threshold voltage of the video signal input through the data line is compensated for and then provided to the gate of the driving transistor. Accordingly, the threshold voltage nonuniformity in the driving transistor between the pixels and current and brightness nonuniformities between the pixels can be eliminated enabling improved gray-scale or full-color display.

According to the threshold voltage compensation circuit block of the present invention, there is no need to increase the number of transistors for each pixel and therefore no reduction in the light emitting area of the pixels appears. The use of the threshold voltage compensation circuit block improves device yield, brightness, and lifetime, unlike the conventional art.

According to the present invention, one threshold voltage compensation circuit block is commonly connected to a plurality of addressing thin film transistors, so that integration efficiency is ensured for displays, and high-definition, large-sized displays can be implemented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An active drive organic light emitting diode display panel circuit having a plurality of pixels, each of which includes an addressing transistor, a storage capacitor, an organic light emitting diode, and a driving transistor connected in series to the organic light emitting diode, the active drive organic light emitting diode display panel circuit comprising a threshold voltage compensation circuit block outside the pixels so that a video signal loaded in a data line is transmitted to the pixels via the threshold voltage compensation circuit block, wherein the threshold voltage compensation circuit block comprises at least two thin film transistors connected in parallel.

2. The active drive organic light emitting diode display panel circuit of claim 1, wherein at least two threshold voltage compensation circuit blocks are connected in parallel to the data line.

3. The active drive organic light emitting diode display panel circuit of claim 1, wherein at least one of the thin film transistors has the same conductivity type as the driving transistor.

4. The active drive organic light emitting diode display panel circuit of claim 1, wherein when the at least two thin film transistors have different conductivity types, the at least two thin film transistors are connected in parallel with a common gate.

5. An active drive organic light emitting diode display panel circuit having a plurality of pixels, each of which includes an addressing transistor, a storage capacitor, an organic light emitting diode, and a driving transistor connected in series to the organic light emitting diode, the active drive organic light emitting diode display panel circuit comprising a threshold voltage compensation circuit block outside the pixels which is common to at least two pixels so that a video signal loaded in a data line is transmitted to each of the pixels via the corresponding threshold voltage compensation circuit block, wherein the threshold voltage compensation circuit block comprises at least two thin film transistors connected in parallel.

6. The active drive organic light emitting diode display panel circuit of claim 5, wherein at least two threshold voltage compensation circuit blocks are connected in parallel to the data line.

7. The active drive organic light emitting diode display panel circuit of claim 5, wherein the threshold voltage compensation circuit block is connected in parallel to the at least two pixels.

8. The active drive organic light emitting diode display panel circuit of claim 5, wherein at least one of the thin film transistors has the same conductivity type as the driving transistor.

9. The active drive organic light emitting diode display panel circuit of claim 5, wherein when the at least two thin film transistors have different conductivity types, the at least two thin film transistors are connected in parallel with a common gate.

* * * * *